US007513465B2

(12) United States Patent
Prado

(10) Patent No.: US 7,513,465 B2
(45) Date of Patent: Apr. 7, 2009

(54) ATTACHABLE BABY BOTTLE HOLDER

(76) Inventor: Richard Prado, 800 Sinclair Ave., Midland, TX (US) 79705

( * ) Notice: Subject to any disclaimer, the term of this patent is extended or adjusted under 35 U.S.C. 154(b) by 593 days.

(21) Appl. No.: 11/350,979

(22) Filed: Feb. 9, 2006

(65) Prior Publication Data

US 2007/0181754 A1 Aug. 9, 2007

(51) Int. Cl.
*A47D 15/00* (2006.01)
*A61J 9/06* (2006.01)

(52) U.S. Cl. ..... 248/102; 248/104

(58) Field of Classification Search ..... 248/102, 248/104; 224/625, 600, 620, 609
See application file for complete search history.

(56) References Cited

U.S. PATENT DOCUMENTS 3,791,746 A * 2/1974 Yearka ..... 401/201
4,473,907 A 10/1984 Maillard
4,564,957 A 1/1986 Scharf
5,013,171 A * 5/1991 Almond, II ..... 401/6
5,060,835 A * 10/1991 Payne ..... 224/148.2
5,765,225 A 6/1998 Goeckeritz et al.
5,820,084 A 10/1998 Trumbauer et al.
5,898,940 A 5/1999 Cameron
6,601,803 B1 * 8/2003 Juranek ..... 248/102
D482,863 S * 12/2003 Flood ..... D3/224
RE38,393 E 1/2004 Bronson
6,971,562 B2 * 12/2005 Willows et al. ..... 224/148.4

* cited by examiner

*Primary Examiner*—Amy J. Sterling
(74) *Attorney, Agent, or Firm*—Anthony Claiborne

(57) ABSTRACT

An apparatus to retain an infant's beverage container, such as a bottle or sippy cup, is designed to be removably fitted on the baby in the manner of a harness. The apparatus securely retains the container and allows snugging of the harness at such a location on the infant that the container is positioned so that it may be easily drunk from and manipulated by the infant. The apparatus further permits the infant to move about freely. Embodiments permit easy adjustment of the apparatus to fit both baby and container. Embodiments also permit easy cleaning of the apparatus. Embodiments are adaptable to retain other items used by the infant, such as toys or pacifiers. By employing this invention, the bottle, sippy cup or other retained item avoids contact with the ground and its consequent contamination, and yet the item is accessible to the infant at all times.

8 Claims, 5 Drawing Sheets

ATTACHABLE BABY BOTTLE HOLDER

BACKGROUND OF THE INVENTION

1. Field of the Invention

The present invention relates to a harness holding a baby bottle or sippy cup which allows the infant to manipulate the cup and drink from it while in the holder.

2. Description of the Related Art

There has been a need in the past for a means for holding a baby bottle where a mother or caretaker does not have to hold the baby's bottle for nursing for extended periods of time. Further, there has been a need to provide a means for holding a baby bottle where the mother or caretaker may perform other functions such as driving a car or performing household functions.

A number of efforts have been made in the past to devise baby bottle holders. For example, see U.S. RE38,393, to Bronson, for a harness/combination vest, wherein a child's bottle may be placed so that the bottle is available for the child when he/she is hungry or thirsty. Bronson's vest, however, restrains the infant, and does not permit the infant to move about while wearing the harness.

Another combination bib and bottle support is shown in U.S. Pat. No. 5,898,940, to Cameron, teaching a combined bib and bottle holder for a child having a front and rear panel sewn together and enclosing a soft material. A pair of upper portions is formed on the front and rear panels for forming a neck hole. Cameron's bib, however, does not permit the infant to manipulate the bottle or cup.

Additionally, U.S. Pat No. 5,820,084. to Trumbauer et al., discloses a baby bottle supporting bib constructed of a washable cloth bib having mounted to its face a covered foam member with a groove or trough for holding the baby bottle. Like, Cameron's bib, however, the Trumbauer bib does not permit the infant to manipulate the beverage container.

U.S. Pat. No. 4,630,319 describes an article holding mechanism for a garment and other surfaces. It does not involve a strap or harness, nor is it designed to permit the wearer to drink from the cup while the cup is retained in the cup holder.

Various other attempts have been made in the prior art with respect to providing baby bottle holders.

What is needed, however, is a baby bottle holder which may be directly attached to the baby. What is needed further is such a baby bottle holder which also permits the baby to manipulate and drink from the cup while the cup is in the holder. What is needed yet further is such a baby bottle holder which permits the baby to move about while the holder is attached to the baby.

BRIEF DESCRIPTION OF THE INVENTION

The present invention is an apparatus to retain an infant's beverage container, such as a bottle or sippy cup, the apparatus designed to be removably fitted on the baby in the manner of a harness. The apparatus securely retains the container in such a manner that the container may be easily drunk from and manipulated by the infant. The apparatus further permits the infant to move about freely. Embodiments permit easy adjustment of the apparatus to fit both baby and container. Embodiments also permit easy cleaning of the apparatus. By employing this invention, the bottle or sippy cup avoids contact with the ground and its consequent contamination, and yet the container is accessible to the infant at all times.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

The present invention is a harness which attaches to a person and holds a bottle or sippy cup securely, while allowing the wearer to manipulate it and drink from it.

Figure 1A:
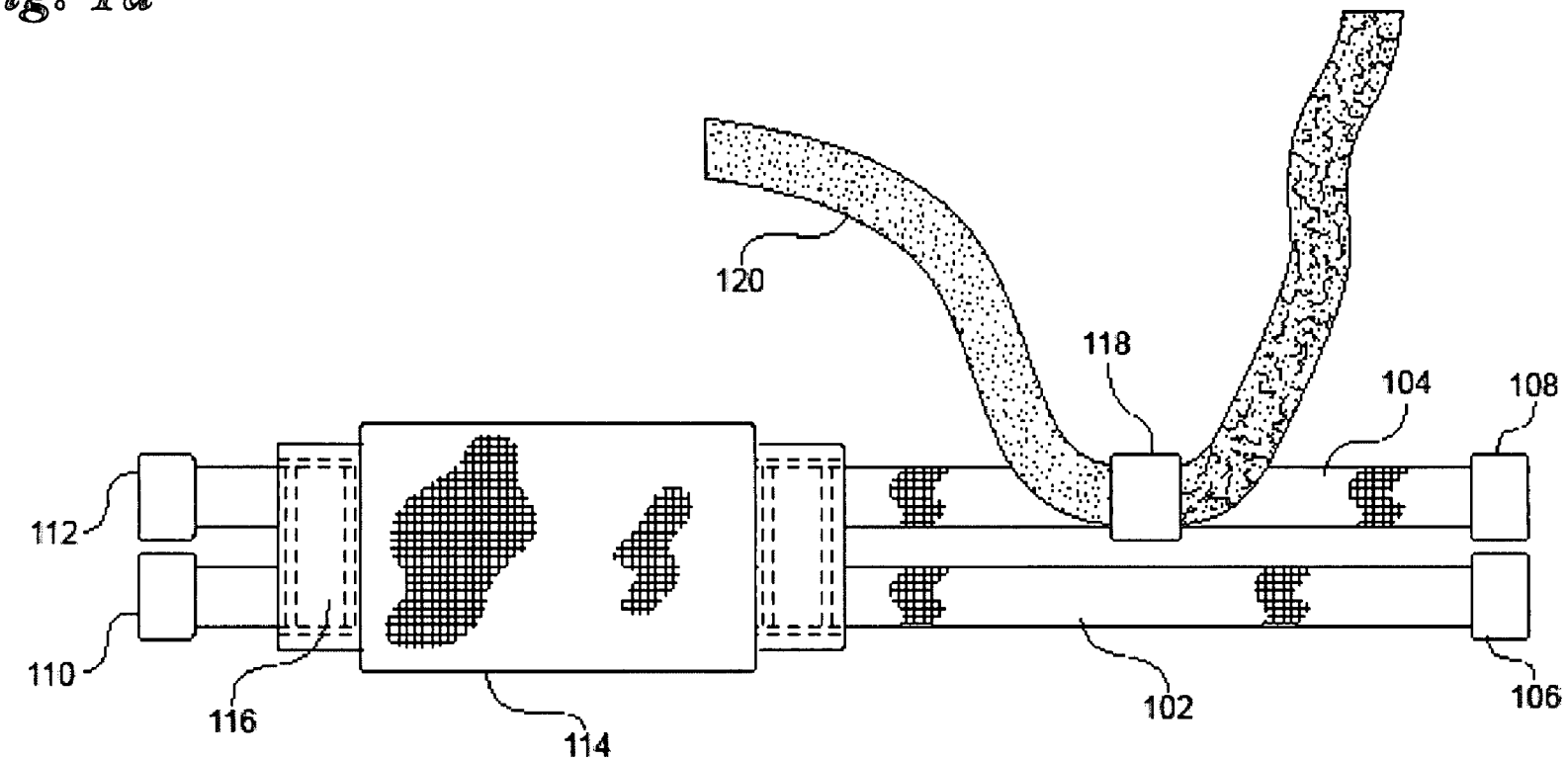
FIG. 1*a* is a side elevation view of a baby bottle supporting holder in accordance with the present invention showing detail of materials while unfastened.

Turning to FIG. 1*a*, depicted is a front elevation of an example of the invention, unfastened and laid flat. The depicted example of the invention comprises a 2.5"×6"×1" sponge backing covered in a colorful cloth material (114). Two nylon belts ((102) and (104)) are sewn to one side of the cloth material attaching to two means for fastening, such as adjustable buckles ((106) and (108)) sewn on one side of the belts, engaging with cooperating pieces ((110) and (112)) on the opposite side. The bottom belt (104) serves as the harness that surrounds the infant. The top belt (102) is equipped with a sliding holder loop (118) connected to a means (120) for adjustably retaining an object such as a bottle or sippy cup. Examples of adjustable retaining means (120) retain an object, such as a bottle or sippy cup, by hook and loop technology such as provided by Velcro® or similar fastener.

Figure 1B:
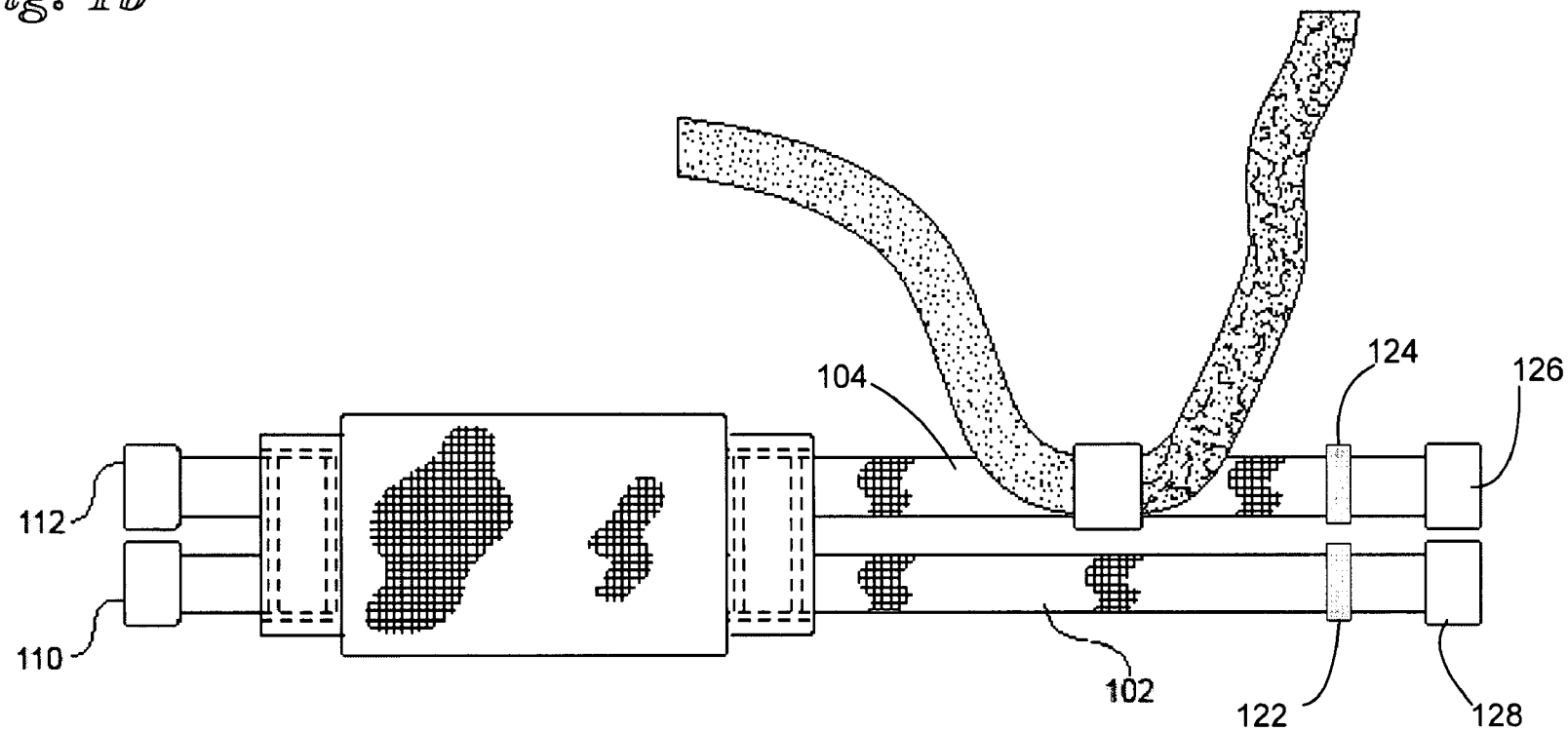
FIG. 1*b* is side elevation view of an alternative embodiment of a baby bottle supporting holder.

The two adjustable buckles ((106) and (108)) depicted in FIG. 1*a* provide a means to adjust the length of belts (102) and (104) to snug the invention to fit an individual infant. In the alternative, as depicted in FIG. 1*b*, means ((122) and (124)) may be provided for snugging belts ((102) and (104)), separate from buckles ((126) and (128)).

The adjustability of retaining means (120) enables the invention to accommodate and securely retain all sizes and designs of bottles or sippy cups currently on the market. The sliding loop (118) retaining fastening means (120) allows the bottle or sippy cup to be centered in front of the infant, regardless of the infant's size. A further benefit of the embodiment just described is that it is composed of machine washable materials and may be laundered regularly as needed.

Figure 2:
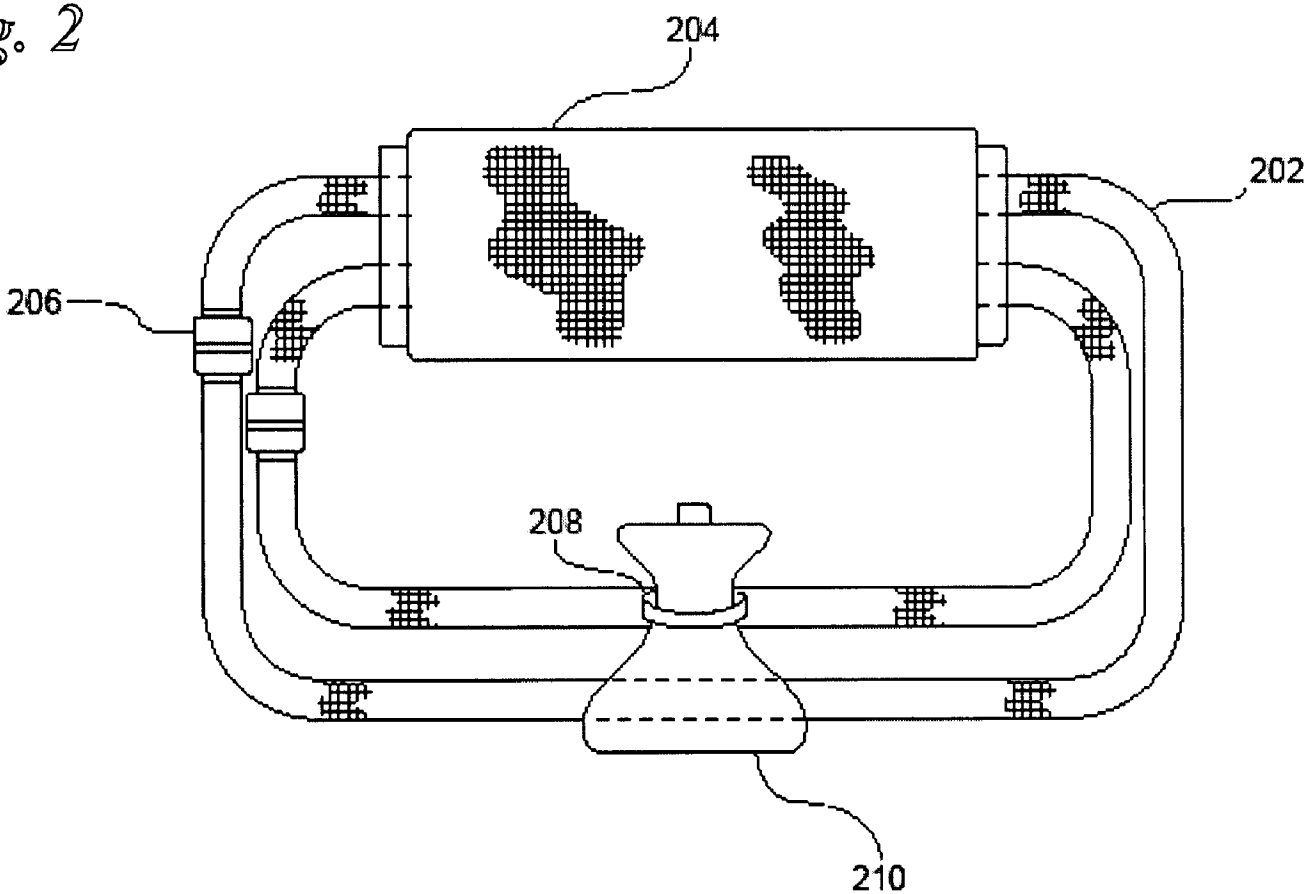
FIG. 2 is a top elevation view of a baby bottle supporting holder in accordance with the present invention with a bottle secured.

Turning to FIG. 2, depicted is a top elevation of the invention fastened as it would appear when worn by an infant. The bottle or sippy cup (210) is shown securely fastened in an adjustable retaining means, such as a Velcro strap (208). The nylon belts (202) are fastened to length with the adjustable buckles (206).

Figure 3:
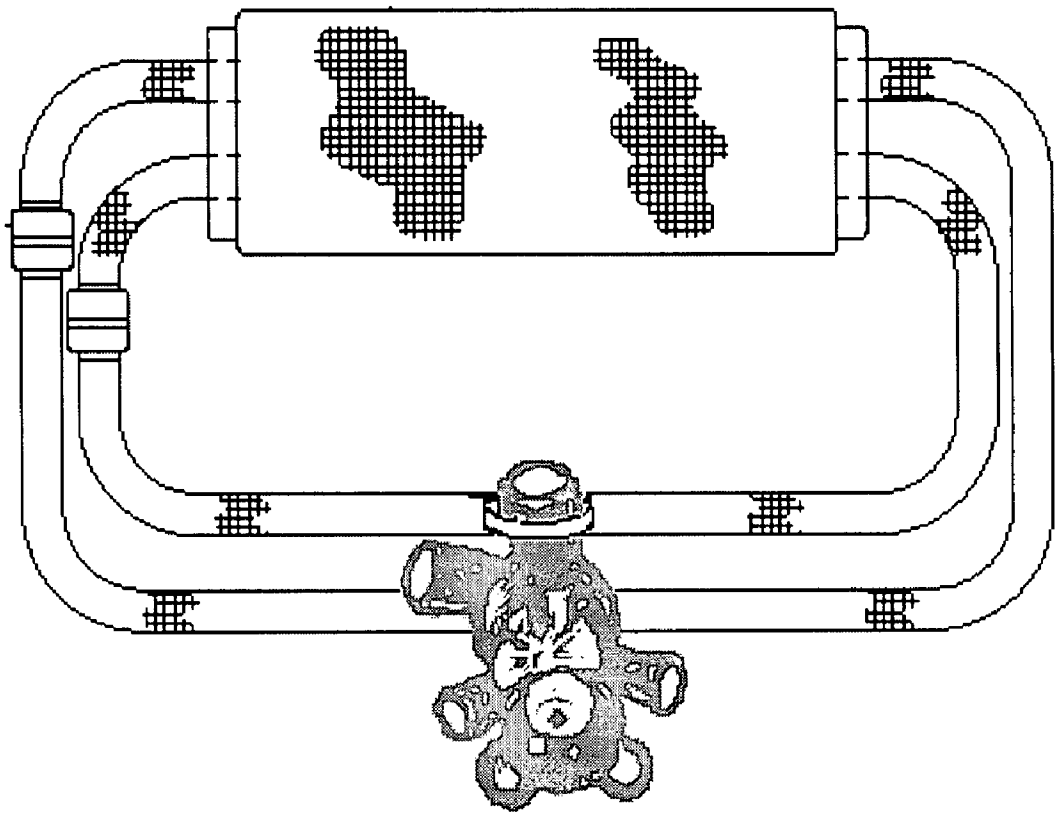
FIG. 3 is a top elevation view of a holder in accordance with the present invention, securing a toy.

While the foregoing description has been directed to the use of the holder for retaining a sippy cup or bottle, the invention may also be employed to retain other items of utility for the infant. As shown in FIG. 3, the holder may be used to retain a toy (302), permitting the infant to manipulate the toy while retaining the toy within reach should the infant drop it.

Figure 4:
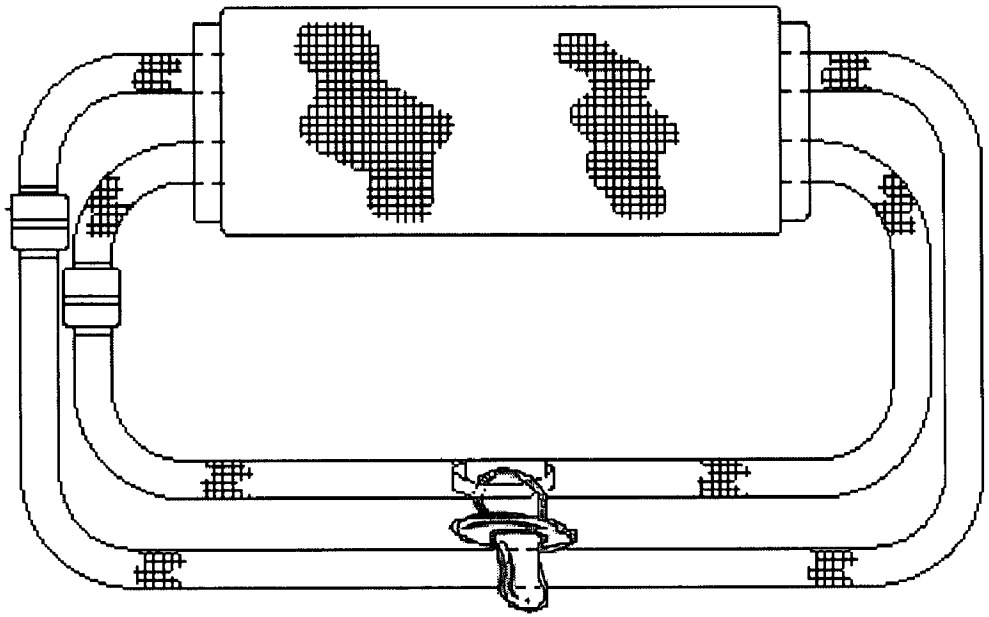
FIG. 4 is a top elevation view of a holder in accordance with the present invention, securing a pacifier.

In a similar fashion, as shown in FIG. 4, the holder may be used to retain a pacifier (402) in easy reach.

As will be clear to those of skill in the art, many other embodiments are possible which are still in keeping with the spirit of the present invention. A wide variety of materials may be employed. For example, belts (102 and 104 in FIGS. 1*a* and 1*b*, 202 in FIG. 2) may be comprised of a material other than nylon, such as appropriately hemmed canvas, which provides the strength, flexibility and washable quality found in the preferred embodiment. Further, fastening means (120 in FIGS. 1*a* and 1*b*, 208 in FIG. 2), means for fastening the strap ends (106 and 108 in FIG. 1*a*; 126 and 128 in FIG. 1*b*; 206 in FIG. 2) and snugging means (supplied by adjustable buckles 106 and 108 in the example depicted in FIG. 1*a* and as separate elements 122 and 124 in FIG. 1*b*) may be replaced with any from a wide variety of fastening and adjustment means known to those of skill in the art, the resultant embodiment still retaining the advantages taught by the present invention.

CONCLUSIONS, RAMIFICATIONS, AND SCOPE

Accordingly, it can be seen that the invention described herein provides a harness to hold a bottle or sippy cup which allows manipulation by the wearer to drink from the attached bottle.

Although the detailed descriptions above contain many specifics, these should not be construed as limiting the scope of the invention but as merely providing illustrations of some of the presently preferred embodiments of this invention. Various other embodiments and ramifications are possible within its scope, a number of which are discussed in general terms above.

While the invention has been described with a certain degree of particularity, it should be recognized that elements thereof may be altered by persons skilled in the art without departing from the spirit and scope of the invention. Accordingly, the present invention is not intended to be limited to the specific forms set forth herein, but on the contrary, it is intended to cover such alternatives, modifications and equivalents as can be reasonably included within the scope of the invention. The invention is limited only by the following claims and their equivalents.

I claim:

1. An attachable baby cup holder, comprising:

an absorbent mass, having a front side and a back side;

at least one belt affixed to the back side of the absorbent mass, the belt having two ends;

a means for fastening the two ends of each said belt together;

a means for snugging the fastened belt around an infant's chest at a selected position;

a loop slidably connected to at least one belt; and a means for adjustably retaining a sippable beverage container within sight and reach of the infant, the retaining means connected to the loop and permitting the infant to drink from the container while it is retained in the holder.

2. An attachable baby bottle holder according to claim 1, wherein the absorbent mass comprises a sponge, and cloth material covering the sponge.

3. An attachable baby bottle holder according to claim 1, comprising two belts.

4. An attachable baby bottle holder according to claim 1, wherein the means for fastening the ends of a belt together is a buckle.

5. An attachable baby bottle holder according to claim 1, wherein the means for fastening the ends of a belt together and the means for snugging the belt is an adjustable buckle.

6. An attachable baby bottle holder according to claim 1, wherein the adjustable retaining means comprises hook and loop material.

7. An attachable infant item holder for retaining an item of interest for an infant, the holder comprising:

an absorbent mass, having a front side and a back side;

at least one belt affixed to the back side of the absorbent mass, the belt having two ends;

a means for fastening the two ends of each said belt together;

a means for snugging the fastened belt around an infant's chest at a selected position;

a loop slidably connected to at least one belt; and a means connected to the loop for adjustably retaining an item within sight and reach of the infant, permitting the infant to use the item while it is retained in the holder.

8. An attachable infant item holder, comprising:

an absorbent mass, having a front side and a back side;

at least one belt affixed to the back side of the absorbent mass, the belt having two ends;

a means for fastening the two ends of each said belt together;

a means for snugging the fastened belt around an infant's chest at a selected position;

a loop slidably connected to at least one belt; and a means connected to the loop for adjustably retaining an item, the item comprising at least one of a sippable beverage container, a toy and a pacifier within sight and reach of the infant, the retaining means permitting the infant to use the item while it is retained in the holder.

* * * * *